US009927130B2

(12) United States Patent
Ortmann et al.

(10) Patent No.: US 9,927,130 B2
(45) Date of Patent: Mar. 27, 2018

(54) GLASS CERAMIC COOKTOP WITH KNOB PATTERN

(71) Applicant: Schott AG, Mainz (DE)

(72) Inventors: Jan-Peter Ortmann, Klein-Winternheim (DE); Dennis Puntheller, Guldental (DE); Klaus Frank, Mainz (DE); Gerold Ohl, Sulzheim (DE)

(73) Assignee: SCHOTT AG, Mainz (DE)

( * ) Notice: Subject to any disclaimer, the term of this patent is extended or adjusted under 35 U.S.C. 154(b) by 200 days.

(21) Appl. No.: 14/197,943

(22) Filed: Mar. 5, 2014

(65) Prior Publication Data

US 2014/0251977 A1 Sep. 11, 2014

(30) Foreign Application Priority Data

Mar. 5, 2013 (DE) ..... 10 2013 102 130

(51) Int. Cl.
*H05B 3/68* (2006.01)
*F24C 15/10* (2006.01)
*H05B 3/74* (2006.01)

(52) U.S. Cl.
CPC ..... *F24C 15/10* (2013.01); *H05B 3/74* (2013.01)

(58) Field of Classification Search
CPC ..... F24C 15/10; H05B 3/74
See application file for complete search history.

(56) References Cited

U.S. PATENT DOCUMENTS 5,357,079 A * 10/1994 Henry ..... H05B 3/746 126/211
6,153,837 A * 11/2000 Garcia ..... F24C 7/083 200/18
2005/0118382 A1 6/2005 Hobon
2013/0286630 A1* 10/2013 Guiset ..... F24C 7/083 362/23.1

FOREIGN PATENT DOCUMENTS

| | | | | |
|---|---|---|---|---|
| CN | 1666574 | | | 9/2005 |
| DE | 19633706 | A1 | | 2/1998 |
| DE | 10211520 | A1 | | 9/2003 |
| DE | 10240147 | A1 | | 3/2004 |
| DE | 10344439 | | * | 2/2005 |
| DE | 10344439 | B3 | | 2/2005 |
| DE | 102005002952 | A1 | | 7/2006 |
| DE | 102005002952 | | * | 1/2012 |
| DE | 102010032113 | A1 | | 1/2012 |
| WO | 03086019 | A1 | | 10/2003 |
| WO | 2003086019 | | * | 10/2003 |
| WO | 2012059664 | | * | 5/2012 |

OTHER PUBLICATIONS

European Patent Office Search Report dated Jul. 1, 2014 corresponding to European Patent App. 14156696.8 with English translation.
German Office Action dated Oct. 10, 2013 corresponding to German Patent App. 10 2013 102 130.1 with English translation.

* cited by examiner

*Primary Examiner* — Shawntina Fuqua
(74) *Attorney, Agent, or Firm* — Ohlandt, Greeley, Ruggiero & Perle, L.L.P.

(57) ABSTRACT

A glass ceramic cooktop is provided, which has a knob pattern that is ground off in a peripheral area of the cooktop to create a flat facet with a shallow angle, which can be used as a display area.

17 Claims, 2 Drawing Sheets

GLASS CERAMIC COOKTOP WITH KNOB PATTERN

CROSS REFERENCE TO RELATED APPLICATIONS

This application claims benefit under 35 U.S.C. § 119(a) of German Patent Application No. 10 2013 102 130.1, filed Mar. 5, 2013, the entire contents of which are incorporated herein by reference.

BACKGROUND OF THE INVENTION

1. Field of the Invention

The invention relates to a glass ceramic cooktop which comprises a glass ceramic plate having a flat upper surface and a lower surface with a knob pattern thereon, and radiant heating elements or induction heating disposed below the glass ceramic plate and leaving open partial areas around the heating.

2. Description of Related Art

From DE 196 33 706 C2, glass ceramic plates for cooktops are known, which are provided with a knob pattern on their lower surface, except for a band free of knobs. In the area of this knob-less band, the upper and lower surfaces of the glass ceramic plate exactly run in parallel to each other, so that capacitive sensors can be mounted there.

The knob pattern on the lower surface of the glass ceramic plate renders the latter less susceptible to scratches during manufacturing and in assembly. The knobs have a height ranging between 40 and 200 μm and are clearly visible from the smooth upper surface through the glass ceramic plate. This even applies if a display area is provided below the glass ceramic plate. Therefore, it is desired to have the knobs removed there. However, glass ceramic plates for cooktops are very sensitive, so that grinding off the knobs appears questionable. Namely, since the height of the knobs varies it is in fact almost impossible to grind off the knobs alone, rather it is necessary to grind a bit into the surface of the bottom side of the cooktop. This, however, creates a step in the cooktop, entailing a risk of breakage along this step, namely when subjected to a load, i.e. a load from above during use.

SUMMARY

An object of the invention is to provide a glass ceramic cooktop comprising a glass ceramic plate which is free of knobs in at least one display area.

This object is achieved by having the knob-free display area displaced to the periphery of the glass ceramic plate and forming it as a ground and polished flat facet that merges continuously into the lower surface of the cooktop which is provided with knobs.

As a facet, the ground and polished display area has an inclination angle, albeit small, relative to the plane of the plate, so that there is a continuous transition between the smooth surface of the display area and the knobbed surface. The angle may be referred to as a flat angle, however an obtuse angle can also be found at the body of the glass ceramic plate, namely between the knobbed area and the facet. It has been found that in this manner the sensitive glass ceramic plate can be employed for use in an improved glass ceramic cooktop without a risk of damage or breakage.

The inclination angle of the flat facet relative to the plate plane of the glass ceramic plate preferably ranges from 2° to 6°. The width of the flat facet may range from 10 to 60 mm, depending on the cooktop. In order to cover structures below the cooktop, the glass ceramic plate may be provided with a lower surface coating except for the display area.

DETAILED DESCRIPTION

Figure 1:
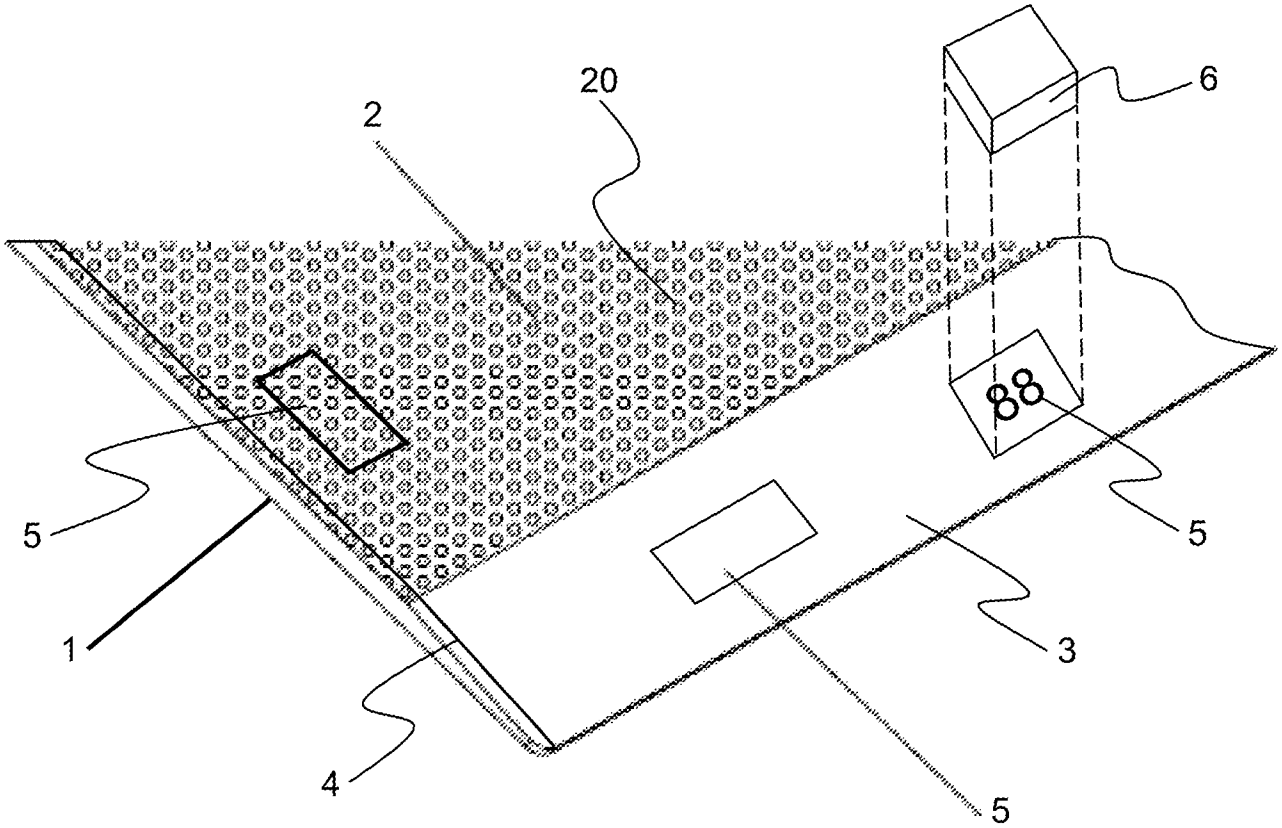
FIG. 1 is a slightly perspective view of the lower surface of a glass ceramic plate.
Figure 2:
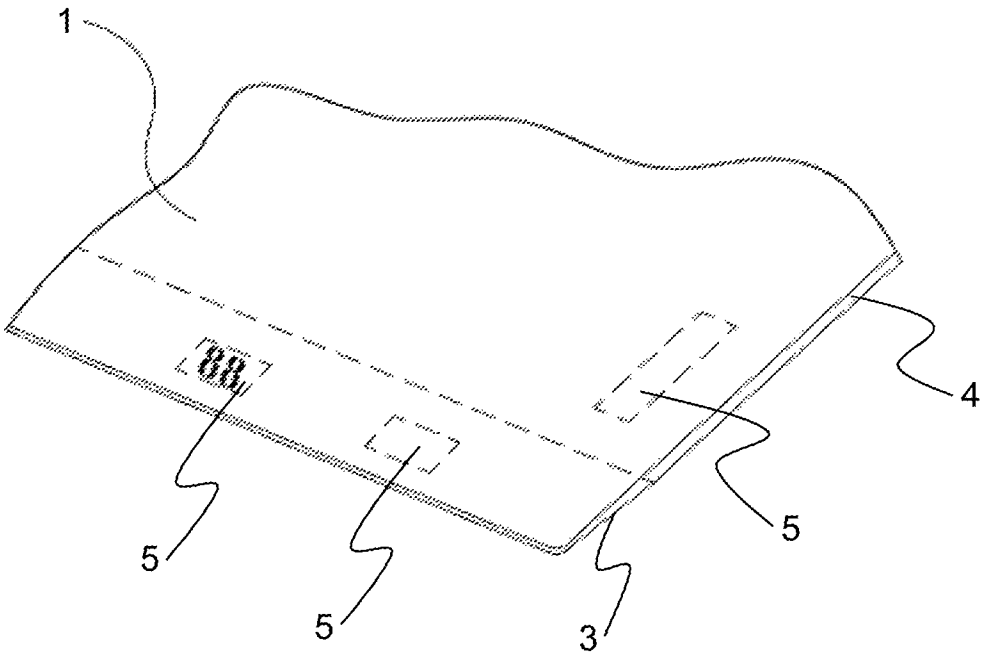
FIG. 2 shows the upper surface of the glass ceramic plate.

One exemplary embodiment will be described with reference to the drawings. FIG. 1 is a slightly perspective view of the lower surface of a glass ceramic plate, and FIG. 2 shows the upper surface of the glass ceramic plate.

The illustrated glass ceramic plate has an upper surface 1 and a lower surface 2 provided with knobs 20. Upper surface 1 is smooth and suitable for placing cookware thereon. Knobbed lower surface 2 protects the glass ceramic plate against scratches during processing. The knobs have a height ranging from 40 to 200 μm. A peripheral band of the glass ceramic plate is formed as a knob-free flat facet 3 having a smooth, flat, obliquely inclined surface. Flat facet 3 is produced by grinding and polishing the peripheral portion of the glass ceramic plate, which originally could be provided with knobs until its edge. Facet grinding is achieved in an angular range from 2° to 6° relative to the plane of the plate. In a cooktop for the household sector, the facet grinding angle was 3°, and the width of the facet was 35 mm. Larger plates may have a larger facet band.

Lower surface 2 of the glass ceramic plate is provided with a lower surface coating 4, except for viewing windows 5 which may be provided at positions of the flat facet peripheral area 3 and also in the knobbed area. Lower surface coating 4 covers structures underneath the cooktop.

In viewing windows 5, symbols or lettering may appear, such as those projected from below onto the associated viewing window 5 by LED display units 6, for example.

It goes without saying that the glass ceramic cooktop has heating elements associated therewith, which are positioned below the glass ceramic plate, but need not be shown.

What is claimed is:

1. A glass ceramic cooktop, comprising:

a glass ceramic plate having an upper side with a smooth upper surface, and a lower side with a lower surface comprising a knob pattern on the lower surface, and a peripheral edge on the lower side; and heating elements arranged below the glass ceramic plate;

wherein the peripheral edge on the lower side is a ground and polished flat facet inclined at an inclination angle relative to the lower surface, wherein the peripheral edge adjacent the lower surface is knob-free and is a display area for the glass ceramic cooktop.

2. The glass ceramic cooktop as claimed in claim 1, wherein the inclination angle relative to the lower surface is in a range of 180° minus 2° to 6°.

3. The glass ceramic cooktop as claimed in claim 2, wherein the ground and polished flat facet has a width ranging from 10 to 60 mm.

4. The glass ceramic cooktop as claimed in claim 1, wherein the ground and polished flat facet has a width ranging from 10 to 60 mm.

5. The glass ceramic cooktop as claimed in claim 1, wherein the display area comprises a plurality of display areas.

6. The glass ceramic cooktop as claimed in claim 5, wherein the glass ceramic plate further comprises a lower surface coating and the plurality of display areas are defined by an open area in the lower surface coating.

7. The glass ceramic cooktop as claimed in claim 6, further comprising an LED display unit associated with at least one of the plurality of display areas.

8. The glass ceramic cooktop as claimed in claim 1, wherein the glass ceramic plate further comprises a lower surface coating and the display area is defined by an open area in the lower surface coating.

9. The glass ceramic cooktop as claimed in claim 8, further comprising an LED display unit associated with the display area.

10. The glass ceramic cooktop as claimed in claim 1, wherein the inclination angle is configured so that there is a continuous transition between the smooth upper surface and the display area.

11. The glass ceramic cooktop as claimed in claim 1, wherein the knob pattern comprises knobs having a height ranging from 40 to 200 μm.

12. A glass ceramic cooktop, comprising:

a glass ceramic plate having an upper surface, a lower surface, and a peripheral band that extends from the lower surface to an outermost edge, a plurality of knobs having a height ranging from 40 to 200 μm on the lower surface, wherein the upper surface is smooth for receipt of cookware thereon, the peripheral band being knob-free at the lower surface and being inclined to the upper and lower surfaces;

one or more heating elements arranged below the lower surface;

one or more display areas arranged in the peripheral band.

13. The glass ceramic cooktop as claimed in claim 12, wherein the peripheral band is inclined relative to the lower surface by an angle in a range of 180° minus 2° to 6°.

14. The glass ceramic cooktop as claimed in claim 12, wherein the peripheral band has a width ranging from 10 to 60 mm.

15. The glass ceramic cooktop as claimed in claim 12, further comprising a lower surface coating, each of the one or more display areas being defined by at least one open area in the lower surface coating.

16. The glass ceramic cooktop as claimed in claim 12, further comprising an LED display unit associated with at least one of the one or more display areas.

17. The glass ceramic cooktop as claimed in claim 12, further comprising a continuous transition between the smooth upper surface and the peripheral band.

* * * * *